US010471499B2

(12) United States Patent
Pellizzon

(10) Patent No.: US 10,471,499 B2
(45) Date of Patent: Nov. 12, 2019

(54) SYSTEMS FOR COOLING MOLDS FOR METALS OR FOR METAL ALLOYS, AND MOLDING SET COMPRISING SAID COOLING SYSTEM AND AT LEAST ONE MOLD

(71) Applicant: ALFI S.R.L., Noale (IT)

(72) Inventor: Irene Pellizzon, Noale (IT)

(73) Assignee: ALFI S.R.L., Noale (IT)

( * ) Notice: Subject to any disclaimer, the term of this patent is extended or adjusted under 35 U.S.C. 154(b) by 0 days.

(21) Appl. No.: 15/756,589

(22) PCT Filed: Aug. 26, 2016

(86) PCT No.: PCT/IB2016/055100

§ 371 (c)(1),
(2) Date: Mar. 1, 2018

(87) PCT Pub. No.: WO2017/037592

PCT Pub. Date: Mar. 9, 2017

(65) Prior Publication Data

US 2018/0178273 A1 Jun. 28, 2018

(30) Foreign Application Priority Data

Sep. 2, 2015 (IT) ..... 202015000048083

(51) Int. Cl.
*B22C 9/06* (2006.01)
*B22D 17/22* (2006.01)
(Continued)

(52) U.S. Cl.
CPC ..... *B22C 9/065* (2013.01); *B22D 17/2218* (2013.01); *B22D 18/04* (2013.01); *B22D 27/04* (2013.01)

(58) Field of Classification Search
CPC ..... B22C 9/06; B22C 9/065; B22D 17/22; B22D 17/2218; B22D 18/04; B22D 27/04
(Continued)

(56) References Cited

U.S. PATENT DOCUMENTS 3,117,346 A * 1/1964 Bertin et al. ..... B29C 33/04 164/290
4,162,700 A * 7/1979 Kahn ..... B22D 27/04 164/122.1
(Continued)

FOREIGN PATENT DOCUMENTS

CN 201042733 4/2008
CN 100519002 7/2009
(Continued)

*Primary Examiner* — Kevin P Kerns
(74) *Attorney, Agent, or Firm* — Mark M. Friedman

(57) ABSTRACT

System for cooling molds for metals, having one or more main conduits, each for transporting a main flow of a cooling carrier fluid containing compressed air and nebulized water, and a plurality of secondary conduits connected to and originating from the main conduit. The free end of each secondary conduit is susceptible of being inserted into a corresponding channel of a duct made in one of the half-molds of a mold. The main conduit is provided with a shaped closed terminal portion for distributing, into the secondary conduits that radially depart therefrom, substantially equal secondary flows of the cooling carrier fluid, injecting them through the free ends thereof into the corresponding channels of each half-mold.

17 Claims, 4 Drawing Sheets

(51) Int. Cl.
*B22D 18/04* (2006.01)
*B22D 27/04* (2006.01)

(58) Field of Classification Search
USPC ..... 164/348, 122, 125, 126, 128
See application file for complete search history.

(56) References Cited

U.S. PATENT DOCUMENTS

| | | | | |
|---|---|---|---|---|
| 7,964,129 | B1 * | 6/2011 | James | B22C 9/065 165/104.19 |
| 2003/0168199 | A1 * | 9/2003 | Takayama et al. | B22C 9/065 164/312 |
| 2005/0092457 | A1 * | 5/2005 | Park | B22D 17/2218 164/348 |
| 2006/0042771 | A1 * | 3/2006 | Ward | B22C 9/065 164/122 |
| 2009/0315231 | A1 | 12/2009 | Furukawa | |

FOREIGN PATENT DOCUMENTS

| | | |
|---|---|---|
| CN | 103658597 | 3/2014 |
| CN | 104439163 | 3/2015 |
| JP | 2002283035 | 10/2002 |

* cited by examiner

SYSTEMS FOR COOLING MOLDS FOR METALS OR FOR METAL ALLOYS, AND MOLDING SET COMPRISING SAID COOLING SYSTEM AND AT LEAST ONE MOLD

FIELD OF APPLICATION

The present invention regards a system for cooling molds for metals or for metal alloys, and a molding set comprising a mold and said cooling system, according to the preamble of the respective independent claims.

The system, object of the present invention, is intended to be advantageously used for cooling the molds conventionally employed for producing metal or metal alloy manufactured products in many various shapes.

The present system is in particular intended to be used in association with molds with injection die casting at low pressure, but it can be advantageously employed both in systems with pressure die casting and in systems with shell casting.

The present invention is therefore inserted in general in the scope of production of systems and apparatuses for foundries or for the production of metal or metal alloy manufactured products by means of molding.

STATE OF THE ART

Various techniques are known for forming metal manufactured products starting from a molten liquid mass.

For example, the technique of cast molding in molds via gravity is known, which provides for the fall of the molten metal into a generally steel mold.

The mold, or shell, is usually divided into two parts (half-molds) or multiple parts respectively in the case of manufactured products to be made which have a single or multiple dividing surfaces.

The mold can also comprise additional movable elements such as cores or taps which are moved relative to a half-mold.

Also known is the technique of molding with injection die casting at low pressure, in which the molten metal alloy contained in a heated crucible is pushed, usually by means of compressed air, through a vertical conduit generally connected below the lower half-mold. The pressure is maintained for a time necessary for the solidification of the alloy of the mold. The metal alloy remains in the molten state at the start of the casting and in the vertical tube, and once the pressure action has ceased it returns into the crucible.

In the case of pressure die casting, steel forms (molds) made for mechanical working are used, in which the molten metal is pushed by a piston which imparts a high speed thereto (even 100 times greater than that of the casting by gravity).

Also known is the technique of pressure die casting of hot chamber type (the pressure piston is in the chamber of the mold where the molten metal is contained), or cold chamber type (the piston receives an amount of molten metal from a crucible) employing a mold usually formed by two half-molds (or by a mold-holder and by a matrix), of which one is fixed integral to the fixed load-bearing structure of the system, and one movable that can be driven to be moved by means of a hydraulic piston. The two half-molds are locked closed, usually by means of a toggle mechanism.

With the technique of the pressure die casting, the injection, solidification and forming of the molten metal jet is notoriously brief.

The various techniques for forming a metal or a metal alloy from the molten liquid state to the solid state in the desired shape mainly allow the molding of jets in lightweight alloy such as aluminum alloys, magnesium alloys, zinc alloys, copper alloys such as bronzes and brasses, though some ferrous alloys can also be treated.

The aforesaid techniques of molding with gravity jets, low-pressure jets or pressure jets (pressure die casting), or more generally the molding processes which employ forming molds in order to obtain manufactured products made of metal or metal alloy, must confront the problem of controlling the temperature of the mold during the forming process in order to ensure optimal mechanical and aesthetic characteristics for the manufactured product.

For such purpose, today the equipment for the molding of jets for metal alloys is provided with cooling systems comprising ducts (in turn constituted by simple closed holes) made in the zones of the mold where an effective and quick reduction of the temperature is required during solidification of the j et.

Within the ducts, a carrier fluid is made to pass that can for example be pressurized air or water.

In many applications of the molding technologies of the abovementioned type, the two different carrier fluids, i.e. water and air, do not allow achieving an optimal cooling of the molds, with the result that the products are in some cases cooled in an excessively quick manner, with temperature differentials between different parts of the mold that can lead to tensions in the manufactured product or to cracks in the mold, or with overly slow cooling speeds that negatively affect the production process.

More in detail, today the molding of light metal alloys, and in particular of aluminum, usually occurs by associating the steel or cast iron mold with a cooling system with compressed air, which is insufflated at high pressure in the coils made in the same mold in order to then be dispersed in the environment.

Most of the manufactured products made of lightweight alloys, and in particular of aluminum or aluminum alloys, is in fact made starting from the melting of ingots of such alloys for the production of the molten material, which is molded in accordance with the abovementioned different molding techniques.

In accordance with these molding techniques, with each work cycle of the mold, the molten metal—as stated, for example, constituted by aluminum or by an aluminum alloy—is cast or injected at about 700 degrees into the mold.

In practice, it is observed that molding cycle after molding cycle, there is a progressive increase of the temperature of the mold and consequently the work cycle times are increasingly longer.

For such reason, as mentioned above, in order to overcome this drawback ducts are made within the mold, at the points where the overheating is greater. Such ducts are for example in the form of closed holes; a compressed air flow at about 5-8 bar is injected herein, fed by a compressor. Such air flow removes heat from the mold, preventing the overheating.

In order to inject the air inside the mold and at the points where the holes are made, the cooling system provides for arranging shaped tubes, generally comprising a main tube made of metal, such as iron or steel, which is extended inside the mold where it branches out into a plurality of secondary tubes with section smaller than that of the main tube in order to reach (with such secondary tubes) the different holes in the mold itself.

The air cooling systems of the type specified herein have the drawback of varying the quantity of air that they convey due to the different lengths of the secondary tubes and the different positions of connection to the main tube.

This irregularity in the flow of compressed air conveyed by the secondary tubes into the different holes of the mold involves a non-uniform cooling of the mold, which often consequently involves the formation of defects on the final manufactured products.

Such defects are in the form of cracks, slits, fissures or even only internal tensions and they can be visible to the naked eye or only visible to X rays.

In any case, the non-uniformity of cooling induced by the secondary tubes of the system causes undesired discards in the production process.

In addition, from a quality standpoint, the various cooling in the different areas can lead to different shrinkage of the material or to internal tensions, even between one manufactured product and the next, with consequent non-uniformity of production, in particular with regard to mechanical characteristics.

In the air cooling systems that are known today, the secondary tubes originate from the main conduit without due consideration of the problem that the different origin points involve the bleeding of different flows, with different cooling effects, in the end causing non-uniformity of cooling with the abovementioned drawbacks.

As known, the abovementioned water cooling systems are advantageously employed where it is necessary to quickly remove large quantities of heat, such as in the pressure die casting processes. In this case, in fact, the pressure exerted on the molten metal during solidification involves a quick heat exchange with the mold. Thus, it is usually provided to associate a water cooling system with these molds of pressure die casting type, such cooling system having circuits within the mold in order entire high cooling speeds.

The water cooling system is of closed type, unable of course to send the overheated vapor into the environment at the outlet of the mold.

The water is usually suitable treated in order to prevent limescale from negatively affecting the operation thereof.

More in detail, water as heat-removal carrier fluid is much more effective than the use of air, but the use of water cooling systems involves several drawbacks.

A first drawback is given by the thermal shock generated by the passage of the fluid within the ducts made in the body of the mold itself. In case of excessive thermal jump, there is the risk that cracks will be generated on the mold, which can irreparably damage the latter.

In the case of water system made of components separated from the mold, seal problems may occur in the junction zones of such components, with the risk of water losses even within the mold—an event which can jeopardize the correct operation of the latter.

In addition, the heated water exiting from the mold or from the system associated therewith must be suitably treated for the disposal or reuse thereof.

Known from document US 2009315231 is a cooling system for molds which employs an air flow as cooling carrier fluid, with a water flow sprayed therein by means of an atomizer so as to achieve a mixture of air and water drops. The system provides for attaining through channels in the mold, in which the aforesaid mixture is made to flow. The latter, cooling the mold, absorbs heat and produces a lot of vapor. The mixture is then suctioned at the outlet by a pump which, by means of compression, separates the air from the water which is evacuated by means of a water drain tube connected to the pump.

The cooling system described in this patent has in practice shown that it does not lack drawbacks.

It requires the attainment of suitable channels within the mold and a suction pump for circulating the air/vapor flow through the mold, and it also requires the disposal of the liquid phase after its compression in the pump.

A first drawback of this system lies in the high cost and complexity thereof due to the need to create suitable conduits in the mold and in order to treat the cooling mixture once it has exited from the mold.

A second drawback of this system lies in the not very precise cooling action of the mixture that traverses the channels of the mold, expedients in fact not being provided for ensuring a uniformity of flow of such mixture in the different channels.

In this situation, the problem underlying the present invention is therefore to eliminate the problems of the abovementioned prior art, by providing a system for cooling molds for metals or for metal alloys which is capable of removing heat from the mold in a uniform manner. Another object of the present invention is to provide a system for cooling molds for metals or for metal alloys which is capable of removing the optimal quantity of heat from the mold. Another object of the present invention is to provide a system for cooling molds for metals or for metal alloys which is entirely safe for the environment and for man.

Another object of the present invention is to provide a system for cooling molds for metals or for metal alloys which is simple and inexpensive to make and entirely reliable in operation. Another object of the present invention is to provide a system for cooling molds for metals or for metal alloys which does not require costly means for treating the cooling carrier after it has left the mold.

Another object of the present invention is to provide a system for cooling molds for metals or for metal alloys which allows being used in a versatile manner in different application settings, in particular being able to substitute the existing air cooling systems.

BRIEF DESCRIPTION OF THE DRAWINGS

The technical characteristics of the finding, according to the aforesaid objects, can be clearly found in the contents of the below-reported claims and the advantages thereof will be more evident in the following detailed description, made with reference to the enclosed drawings, which represent several merely exemplifying and non-limiting embodiments of the invention, in which:

DETAILED DESCRIPTION OF A PREFERRED EMBODIMENT

Figure 1:
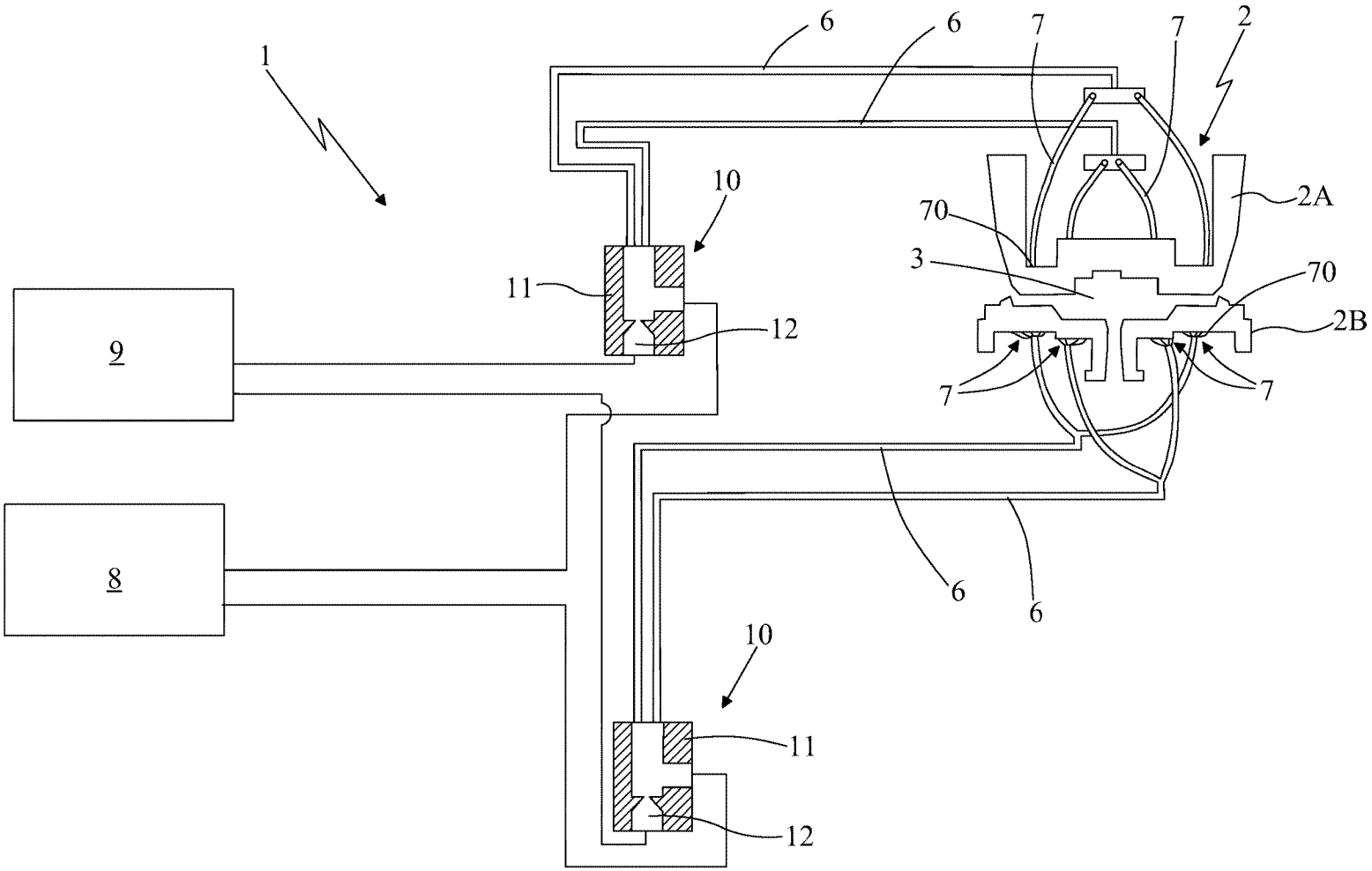
FIG. 1 schematically shows a general view of the cooling system connected to a mold in order to form an assembly according to the invention.

With reference to the enclosed drawings, reference number 1 overall indicates an example of a system for cooling molds for metals connected in a single assembly to a mold indicated with 2, in particular of the type for injection with a low-pressure jet of molten metal or of an alloy of molten metal.

Advantageously the molten metal alloy is a lightweight alloy, such as an aluminum alloy for example employable in molten phase at about 700 degrees.

The mold 2 indicated in the example of the enclosed figures is as stated preferably of the type at low pressure; nevertheless, without departing from the protective scope of the present patent, it can be of different type, such as gravity type or pressure die casting type.

The mold 2 comprises at least two shaped half-molds, of which one is upper 2A and one lower 2B, that can be coupled to close, hermetically sealed on each other, in order to together define a molding chamber 3 adapted to contain the melted metal material.

In a known manner, the mold 2 can also provide for lateral closure portions, which also—together with the half-molds—can contribute to defining the molding chamber 3.

The mold 2, advantageously made of steel or cast iron, will be fed with a quantity of molten metal or of molten metal alloy, for example starting from a crucible by means of a vertical feed tube 4 placed centrally below the lower half-mold 2B.

At least one half-mold and advantageously both the half-molds 2A, 2B are provided with ducts 5 formed by a plurality of channels 5', advantageously obtained with closed holes made inside the half-molds and provided with a closure bottom preferably shaped as a spherical cap.

In each half-mold 2A, 2B, multiple ducts 5 can be defined, which as indicated hereinbelow can be defined multiple ducts 5, which as indicated hereinbelow can be susceptible of receiving at different times the flows of separate cooling carriers from different main conduits.

More in detail, the cooling system comprises at least one main conduit 6, adapted to convey a corresponding main flow of a cooling carrier fluid.

Each duct 5 will be constituted by a group of channels or holes 5' which receive the cooling carrier flow from a corresponding main conduit 6.

Such cooling carrier is obtained with a mixture of compressed air and nebulized water.

The aforesaid main conduit 6, having a first transport section S1, is hydraulically connected to a plurality of secondary conduits 7, which are extended and originate from the same main conduit 6 at the half-mold 2A, 2B to be cooled.

The secondary conduits 7 are each provided with a free end 70, susceptible of being inserted in a corresponding channel 5' made in a half-mold 2A, 2B, and have a second transport section S2 smaller than the first transport section S1 of the main conduit.

Therefore, the mixture of compressed air and nebulized water of the cooling carrier conveyed by each secondary conduit 7 is injected through the end 70 of the latter into the channels 5' of the half-molds 2A, 2B. Since such channels 5' are advantageously in the form of closed holes 5', the mixture that reaches the bottom of the holes 5' will return back in order to exit from the opening mouth 500 of the hole 5' on the external surface of the half-mold 2A, 2B.

The secondary conduits 7 connected to a same main conduit 6 have equivalent secondary section S2.

Both the main conduit 6 and the secondary conduits 7 are made of metal material (e.g. iron or steel), since they must resist the high temperatures transmitted thereto by the mold 2.

The secondary conduits 7 are susceptible of being bent in order to assume the desired shape, for the purpose of allowing their free end 70 to easily reach the opening mouths 500 of the channels 5' made in the half-molds 2A, 2B and remain associated therewith even without the use of retention means.

In order to produce the aforesaid cooling carrier, the system comprises means for feeding at least one compressed air flow 8, e.g. comprising a compressor from which one or more feed conduits depart for the aforesaid at least one compressed air flow; means for feeding at least one water flow 9, e.g. comprising an aqueduct from which one or more feed conduits depart for the aforesaid at least one water flow; and means 10 for mixing the water flow in the air flow. Such mixing means 10 comprise at least one three-way connector 11 connected to a water conduit and to a conduit for the compressed air in order to receive therefrom the corresponding flows of compressed air and water, and a nebulization nozzle 12 in order to nebulize the water flow in the air flow, producing the aforesaid cooling carrier of compressed air and nebulized water.

Such three-way connector 11 feeds a corresponding main conduit 6.

As stated, there can be multiple main conduits 6, each fed by a corresponding three-way connector 11, with which a corresponding conduit for the compressed air and for the water of the respective feed means 8, 9 converge.

In accordance with the idea underlying the present invention, the main conduit 6 is provided with at least one closed terminal portion 60, with which three or more of the aforesaid secondary conduits 7 are radially and peripherally connected. According to the invention the aforesaid closed terminal portion 60 is shaped for distributing, in the secondary conduits 7, substantially equal secondary flows of the cooling carrier fluid by injecting them through their free ends 70 into corresponding channels 5' of the duct 5 of the half-mold 2A, 2B.

The connections of the secondary conduits 7 to the closed terminal portion 60 of the main conduit 6 are made due to holes in the aforesaid closed terminal portion 60, all situated at a distribution circumference of a transverse section of the same closed terminal portion 60 (in both of the embodiments presented hereinbelow).

In other words, all the secondary conduits 7 depart from the main conduit 6 at a same height so as to ensure an identical inflow of air/nebulized water droplet flow in the secondary conduits 7.

As explained above, the secondary conduits 7 are connected to the main conduit 6 at the same height with respect to the closure wall 65 of the end of the main conduit 6.

As mentioned above, the free ends 70 of the secondary conduits 7 are associated with the opening mouths 500 of the channels 5' made in the half-molds 2A, 2B and can remain arranged herein even without the use of retention means adapted to mechanically connect the aforesaid free ends 70 to the aforesaid opening mouths 500. Nevertheless, advantageously, mechanical fixing means are provided (not shown) in order to constrain the cooling system to the mold 2 so as to maintain the free ends 70 of the secondary conduits 7 firmly associated with the opening mouths 500 of the channels 5'. For example, such fixing means can provide for a bracket fixed to the mold 2 and adapted to support (with respect to such mold) the main conduit 6, by gripping in a section placed close to its closed terminal portion 60 or even by gripping directly on the same closed terminal portion 60.

Figure 3:
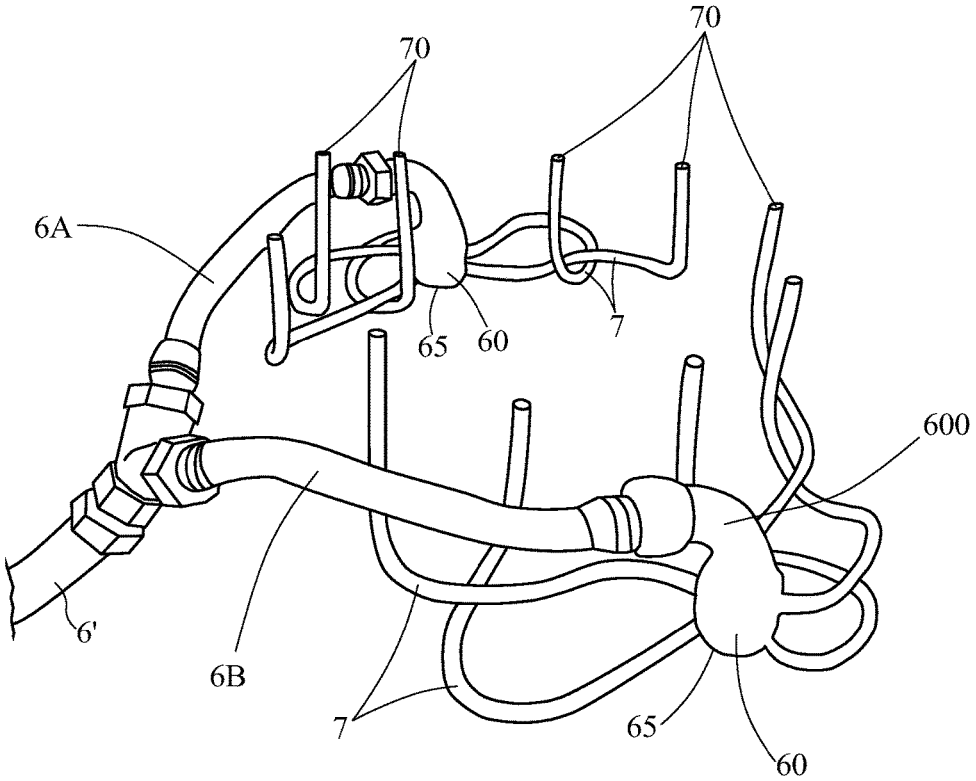
FIG. 3 shows an enlarged detail of a second embodiment of the cooling system according to the invention, relative to the closed terminal portion of the main conduit and with some parts removed in order to better illustrate other parts.
Figure 4:
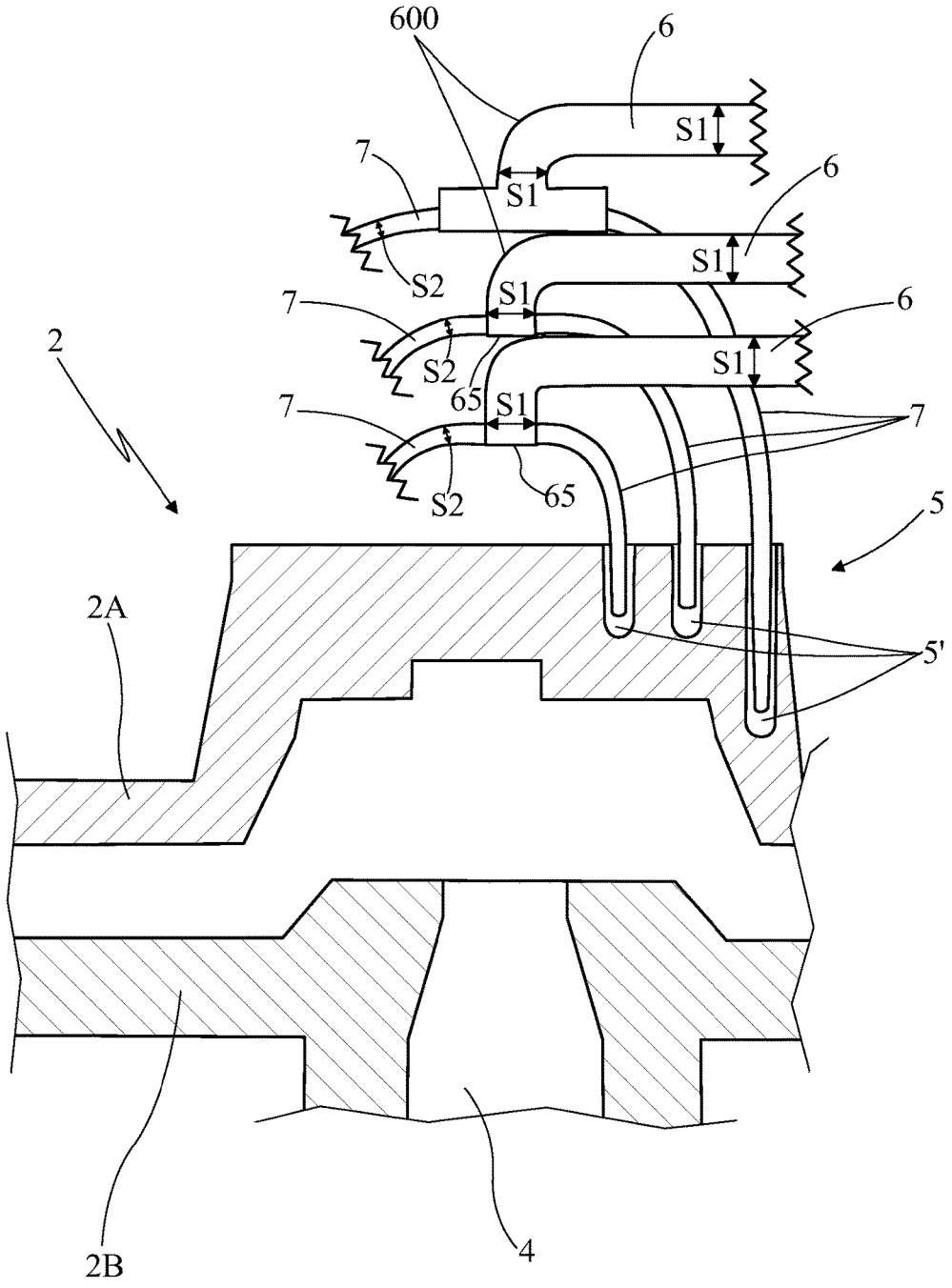
FIG. 4 shows a detail of the assembly according to the invention relative to a mold having the cooling system associated therewith of which, in the detail, the closed terminal portion from which the secondary conduits radially depart is particularly visible.
Figure 5:
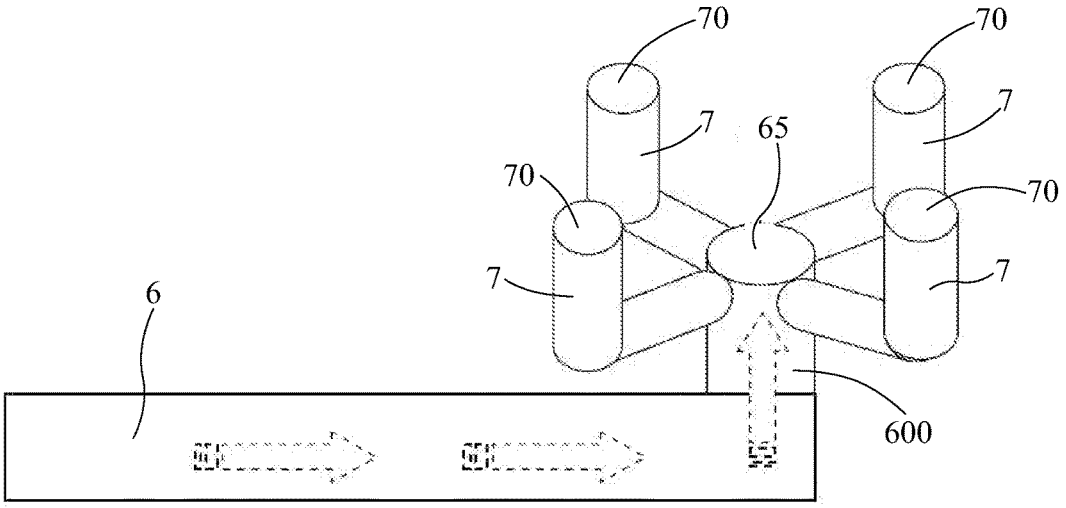
FIG. 5 shows a schematic drawing of the closed terminal portion of the main conduit of the second embodiment of FIG. 3.

In accordance with the embodiment of FIG. 3, the closed terminal portion 60 is obtained by maintaining unchanged the diameter of the main conduit 6, which simply terminates with a closure wall 65.

Advantageously, the main conduit 6 will comprise an orientation section 600 which will terminate with the aforesaid closed terminal portion 60 and which will be provided with a different orientation with respect to the remaining portion of main conduit 6, due to a bend or a connector.

Such orientation section 600 allows better fitting the closed terminal portion 60 with the relative half-mold 2A, 2B.

The secondary conduits 7 circumferentially connected on the main conduit advantageously depart in close vicinity (within 2 cm) from the closure wall 65.

The secondary conduits 7 radially and peripherally originate in proximity to such closure wall 65, advantageously in a circumferentially equidistant manner. For such purpose, the closed terminal portion 60 of the main conduit 6 is provided with second through holes 64, each in communication with a corresponding secondary conduit 7 fixed to the main conduit 6, e.g. by means of welding.

Figure 2:
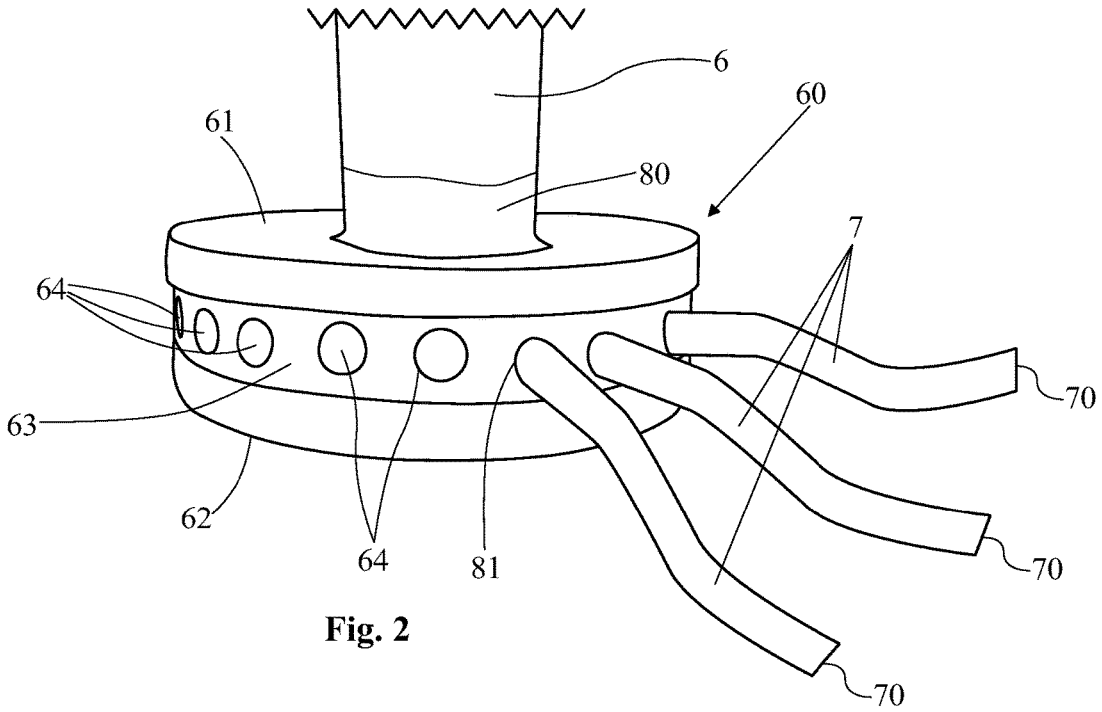
FIG. 2 shows an enlarged detail of a first embodiment of the cooling system according to the invention, relative to a closed terminal portion with an enlarged manifold body of a main conduit and with some parts removed in order to better illustrate other parts.

In accordance with the embodiment of FIG. 2, if the circumference of the main conduit 6 does not allow the connection with a sufficient number of secondary conduits 7, then advantageously the closed terminal portion 60 can be obtained with an enlarged manifold body, in particular with cylindrical shape, provided with two opposite transverse and circular walls 61, 62, and with a peripheral connector wall 63, placed to connect the aforesaid opposite walls 61, 62 and delimiting therewith a distribution chamber for the carrier fluid.

More in detail, a first transverse wall 61 is connected, e.g. by means of welding 80, to the main conduit 6 and for such purpose it is provided with a first through hole of communication with such main conduit 6, in particular placed centrally with respect to the same first transverse wall 61, while the second transverse wall 62 acts as a closure cap for the distribution chamber.

The peripheral wall 63 is provided with a plurality of second through holes 64 (analogously indicated for the preceding embodiment), each connected to a corresponding secondary conduit 7, advantageously circumferentially distributed at regular intervals. Also in this case, the mechanical connection of the secondary conduits 7 to the peripheral wall 63 at the second through holes 64 is obtained by means of welding 81.

The aforesaid enlarged manifold body 60 therefore advantageously has a substantially cylindrical discoidal shape adapted to allow an optimal distribution of the cooling carrier in analogous flows to the secondary conduits 7, which radially depart from such body.

It has been established that an improved distribution of the air/nebulized water cooling carrier is obtained with the distribution chamber of the enlarged manifold body 60 having a height that corresponds to the internal distance between the two opposite transverse and circular walls 61, 62, substantially equal to the diameter of the secondary conduits 7.

The aforesaid enlarged manifold body 60 is therefore advantageously horizontally supported by the relative main conduit 6, in particular so as to centrally face the upper half-mold 2A of the low-pressure injection mold 2.

Indeed, since such mold 2 has a vertical feed tube 4 for the molten metal generally placed centrally below the lower half-mold 2B, it is possible to centrally mount the aforesaid enlarged manifold body 60 on the upper half-mold. Such aforesaid enlarged manifold body 60 cannot however be facing and centrally mounted on the lower half-mold 2B due to the presence of the lower vertical feed tube 4.

In this case, advantageously, the main conduit 6 branches out into at least two branches 6A, 6B from a common feed portion 6', each of which provided at the end thereof with a corresponding closed terminal portion 60, which can be represented by the final section of the same main conduit 6 or by an enlarged manifold body 60, as explained above in order to allow the connection of a greater number of secondary conduits 7.

The two branches 6A, 6B of the main conduit 6 are preferably arranged horizontally, in particular being susceptible of facing the lower half-mold 2B of the abovementioned low-pressure injection mold 2, and in diametrically opposite positions with respect to the vertical feed tube 4 of the mold.

If more than two branches 6A, 6B originating from the main conduit 6 are employed, then the branches will be arranged with the closed terminal portions in uniformly distributed positions with respect to the lower central feed of the half-mold 2B.

The branches 6A, 6B of the main conduit 6 are wrapped around the mold 2, for example with curved extension, in order to seek to maintain a uniform distribution of the secondary conduits 7 which depart from their closed terminal portions 60.

In accordance with an important characteristic of the cooling system 1 according to the invention, the flows of cooling carrier fluid, which are introduced from the free ends 70 of the secondary conduits 7 into the channels 5' of the half-molds 2A, 2B, are not picked up again at the outlet of the channels 5' of the same half-molds 2A, 2B, since a continuation of the cooling system beyond the molds 2 is not provided; instead, it is provided to directly introduce the cooling carrier fluids into the environment. The small quantity of vapor associated with each cooling carrier flow does not constitute any problem with regard to safety nor the environment.

Preferably, as mentioned above, the cooling system 1 provides for feeding each of the two half-molds 2A, 2B with multiple main conduits 6, each carrying a plurality of secondary conduits 7 at the closed terminal portion 60 thereof, and drivable by means of a logic control unit (not shown) to control the single main flows also at different times of the work cycle of the mold 2, for example driving control means for the single main conduits 6, in particular constituted by solenoid valves or by pneumatic valves.

Also forming the object of the present invention is a molding set comprising a mold 2 as well as the cooling system 1 of the type in particular described up to now; for the sake of description simplicity, the same reference numbers and nomenclature used above will be maintained hereinbelow.

The mold 2 is in particular for a low-pressure jet of molten metal or of molten metal alloy, and is in any case provided with at least two half-molds 2A, 2B shaped as explained above, i.e. of which one is upper 2A and one lower 2B, that can be coupled together in order to define the molding chamber adapted to contain the molten metal jet.

According to the idea underlying the invention, each half-mold 2A, 2B is provided with a duct 5 formed by multiple internal channels 5', in which the free ends 70 of the secondary conduits 7 are inserted in order to inject the secondary flows of cooling carrier fluid within the same channels 5'. In addition, according to the idea underlying the invention, such secondary flows of cooling carrier flows are expelled into the outside environment at the outlet of the channels 5', i.e. they are no longer picked up again by the cooling system 1.

Preferably, at least one half-mold and preferably each half-mold 2A, 2B comprises multiple ducts 5, each formed by multiple internal channels 5'. More clearly, each duct 5 can be obtained with groups of holes 5'.

Each duct 5 receives the flow of the cooling carrier from a corresponding main conduit 6, which through its secondary conduits 7 transfers it to the single channels 5' of the aforesaid duct 5.

The logic control unit preferably controls, according to operating steps that can be set or programmed by means of the control means, in particular constituted by control valves, the differentiated feed of each separate main conduit 6 at different times of the work cycle of the mold 2.

The channels 5' of the duct 5 of each half-mold 2A, 2B are advantageously obtained as stated with closed holes, provided with an opening mouth 500 on the external surface of the half-mold 2A, 2B traversed by the secondary conduits 7 as well as by the cooling carrier at the outlet towards the outside environment.

Figure 6:
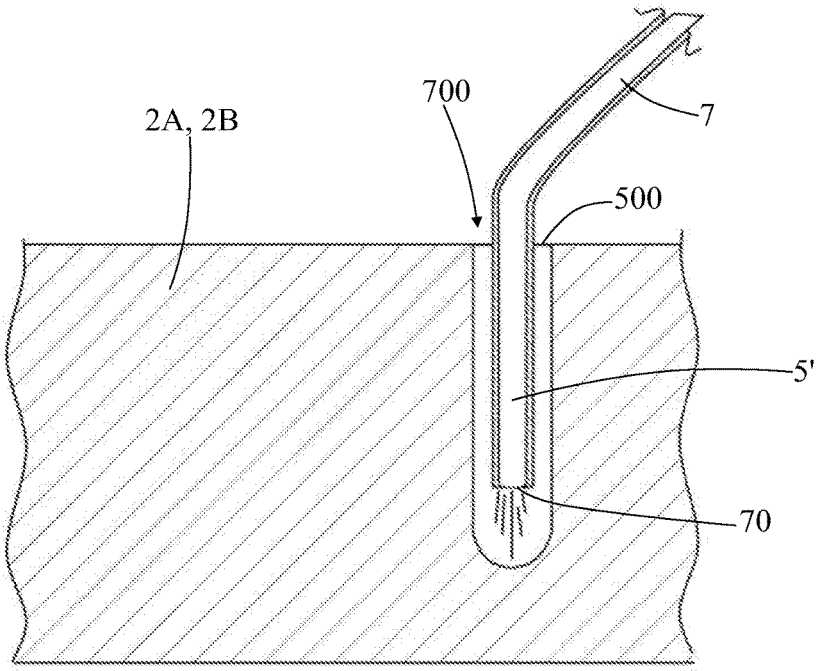
FIG. 6 shows a schematic drawing of an embodiment of the assembly according to the invention relative to the connection of the free end of a secondary conduit to the cooling channel of a mold.

For such purpose, an air space 700, in particular annular, is left between the free end 70 of the secondary conduits 7 and the opening mouth 500 of the hole 5' of the half-mold 2A, 2B (see FIG. 6).

Otherwise, but according to a non-preferable embodiment, the channels 5' of a corresponding duct 5 can have an inlet opening, associated with the free end 70 of the secondary conduits 7, separated from the outlet opening.

Of course, the cooling system 1 and the set, in the practical achievement thereof, can also assume shapes and configurations that are different from those illustrated above, without departing from the present protective scope.

In addition, all the details can be substituted by technically equivalent elements and the sizes, shapes and materials used can be of any type in accordance with the requirements.

The invention claimed is:

1. Cooling system for cooling molds for metals or for metal alloys provided with at least two shaped half-molds, that are coupled together in order to define a molding chamber adapted to contain melted metal material, such cooling system comprising:

at least one main conduit for transporting a main flow of a cooling carrier fluid containing compressed air and nebulized water, having a first transport section (S1);

a plurality of secondary conduits connected to and originating from said at least one main conduit and each provided with a second transport section (S2) smaller than the first transport section (S1) of said at least one main conduit and with a free end susceptible of being inserted in a corresponding channel of a duct made in one of said at least two half-molds;

wherein said at least one main conduit is provided with at least one closed terminal portion, which is radially and peripherally connected to three or more of said secondary conduits; said at least one closed terminal portion being shaped for distributing in said secondary conduits substantially equal secondary flows of said cooling carrier fluid, injecting said secondary flows through the free end thereof into said corresponding channel of a duct made in one of said at least two half-molds;

wherein said cooling system further comprises:

means for feeding a compressed air flow;

means for feeding a water flow; and means for mixing said water flow in said air flow comprising at least one nebulization nozzle in order to nebulize said water flow in said air flow, producing said cooling carrier fluid which feeds said at least one main conduit.

2. Cooling system according to claim 1, wherein said at least one closed terminal portion of said at least one main conduit is provided with second through holes, each hydraulically connected to a corresponding said secondary conduit peripherally fixed to said at least one closed terminal portion; said second through holes being made at a distribution circumference of a transverse section of said at least one closed terminal portion.

3. Cooling system according to claim 1, wherein said at least one closed terminal portion is obtained with an enlarged manifold body provided with two opposite transverse walls and with a peripheral wall placed to connect said opposite transverse walls and delimiting therewith a distribution chamber for the carrier fluid; a first transverse wall of said opposite transverse walls being connected to said at least one main conduit through a first through hole; said peripheral wall being provided with a plurality of second through holes, each connected to a corresponding said secondary conduit.

4. Cooling system according to claim 3, wherein said enlarged manifold body has substantially cylindrical discoidal shape and is horizontally supported by said at least one main conduit.

5. Cooling system according to claim 4, wherein the distribution chamber of said enlarged manifold body has a height substantially equal to the diameter of said secondary conduits.

6. Cooling system according to claim 1, wherein said at least one main conduit maintains said first transport section (S1) unchanged at said at least one closed terminal portion.

7. Cooling system according to claim 1, wherein said at least one main conduit branches out into at least two branches from a common feed portion, each of which is provided with one said at least one closed terminal portion.

8. Cooling system according to claim 7, wherein said at least two branches are horizontally arranged.

9. Cooling system according to claim 7, wherein said at least two branches have curved extension.

10. Cooling system according to claim 1, further comprising two or more main conduits, each of which being fed with a cooling carrier fluid thereof obtained by means of corresponding said means for feeding a compressed air flow, said means for feeding a water flow, and said means for mixing.

11. Cooling system according to claim 1, wherein said secondary conduits are susceptible of being bent in order to assume a shape adapted to bring their free end to mouths of the channels made in said at least two half-molds.

12. Cooling system according to claim 1, wherein said channels are constituted by closed holes.

13. Molding set comprising:

said cooling system according to claim 1 and at least one mold provided with at least two shaped half-molds, including an upper and a lower half-mold, that are coupled together in order to define a molding chamber for containing said jet, wherein each half-mold is provided with a duct formed by multiple internal channels, in which the free ends of said secondary conduits are inserted in order to inject the secondary flows of said carrier fluid within said channels, such said secondary flows being expelled into an outside environment at an outlet of said channels.

14. Molding set according to claim 13, wherein at least one half-mold comprises multiple ducts, each formed by multiple internal channels coupled to the secondary conduits corresponding separate main conduits.

15. Molding set according to claim 14, further comprising a logic control unit capable of controlling, according to operating steps that are settable or programmable by means of control means, a differentiated feed of each separate main conduit.

16. Molding set according to claim 13, wherein the channels of said at least one duct of at least one half-mold are closed holes.

17. Cooling system for cooling molds for metals or for metal alloys provided with at least two shaped half-molds, that are coupled together in order to define a molding chamber adapted to contain melted metal material, such system comprising:

at least one main conduit for transporting a main flow of a cooling carrier fluid containing compressed air and nebulized water, having a first transport section (S1);

a plurality of secondary conduits connected to and originating from said at least one main conduit and each provided with a second transport section (S2) smaller than the first transport section (S1) of said at least one main conduit and with a free end susceptible of being inserted in a corresponding channel of a duct made in one of said at least two half-molds;

wherein said at least one main conduit is provided with at least one closed terminal portion, which is radially and peripherally connected to three or more of said secondary conduits; said at least one closed terminal portion being shaped for distributing in said secondary conduits substantially equal secondary flows of said cooling carrier fluid, injecting said secondary flows through the free end thereof into said corresponding channel of said at least two half-molds;

wherein said at least one closed terminal portion of said at least one main conduit is provided with second through holes, each hydraulically connected to a corresponding said secondary conduit peripherally fixed to said at least one closed terminal portion; said second through holes being made at a distribution circumference of a transverse section of said at least one closed terminal portion.

* * * * *